United States Patent [19]

Burke

[11] 4,197,265

[45] Apr. 8, 1980

[54] WATER VAPOR SUPPLY UNIT FOR FOSSIL FUEL BURNER

[75] Inventor: Michael J. Burke, Boring, Oreg.

[73] Assignee: Western Fuel Reducers, Inc., Troutdale, Oreg.

[21] Appl. No.: 11,328

[22] Filed: Feb. 12, 1979

[51] Int. Cl.[2] ..... B01F 3/04

[52] U.S. Cl. ..... 261/121 R; 126/113; 261/70; 261/74; 261/DIG. 47; 261/DIG. 65

[58] Field of Search ..... 261/70, 74, 119 R, 121 R, 261/23 R, 123, 125, DIG. 15, DIG. 47, DIG. 65, 113

[56] References Cited

U.S. PATENT DOCUMENTS

| | | | |
|---|---|---|---|
| 2,342,602 | 2/1944 | Reitz, Jr. | 261/DIG. 47 |
| 3,089,757 | 5/1963 | Buswell et al. | 261/123 X |
| 3,397,731 | 8/1968 | Gravis et al. | 261/123 X |
| 3,485,015 | 12/1969 | Vecchio | 261/74 X |
| 3,622,132 | 11/1971 | Rawlings, Jr. | 261/DIG. 47 |
| 3,806,102 | 4/1974 | Valenta et al. | 261/DIG. 65 |

FOREIGN PATENT DOCUMENTS

| | | | |
|---|---|---|---|
| 1174520 | 3/1959 | France | 261/DIG. 47 |
| 18871 | of 1907 | United Kingdom | 261/DIG. 47 |
| 307823 | 5/1929 | United Kingdom | 261/125 |

*Primary Examiner*—Richard L. Chiesa
*Attorney, Agent, or Firm*—Klarquist, Sparkman, Campbell, Leigh, Hall & Whinston

[57] ABSTRACT

A water vapor supply unit having a partition dividing a water tank into two compartments above a water line but allowing communication below the water line. A water level control in one compartment maintains the water level in both. One or more air inlet nozzles for each compartment are provided and are of angular form. They are side wall mounted for adjustment for regulation purposes. Each compartment has one or more vapor outlet fittings. A mount for a water level controller assures its proper disposition when mounted in place.

10 Claims, 5 Drawing Figures

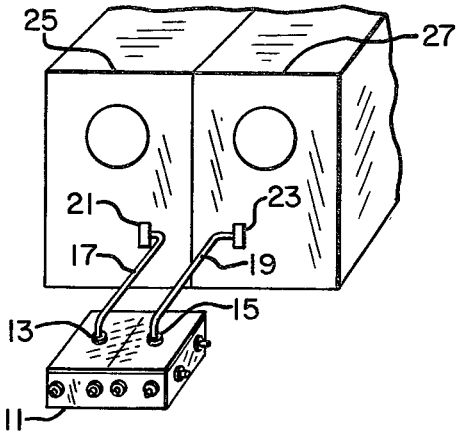
FIG. 1
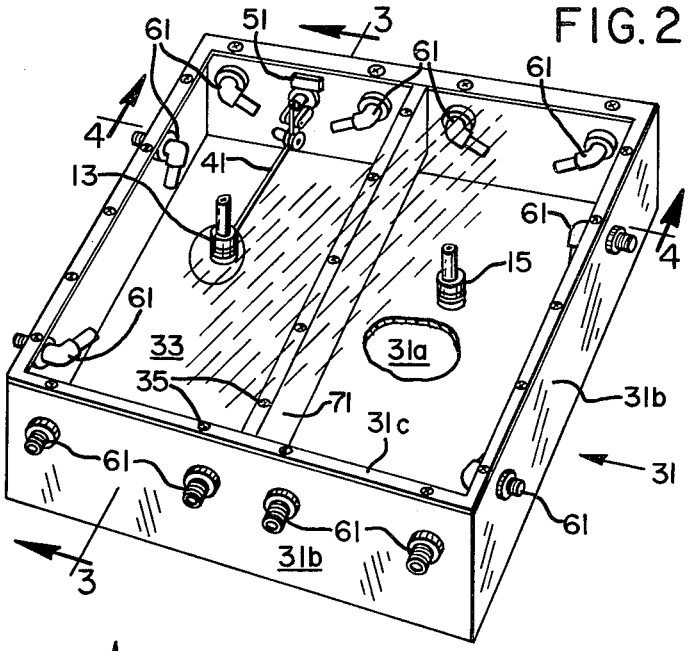
FIG. 2
FIG. 3
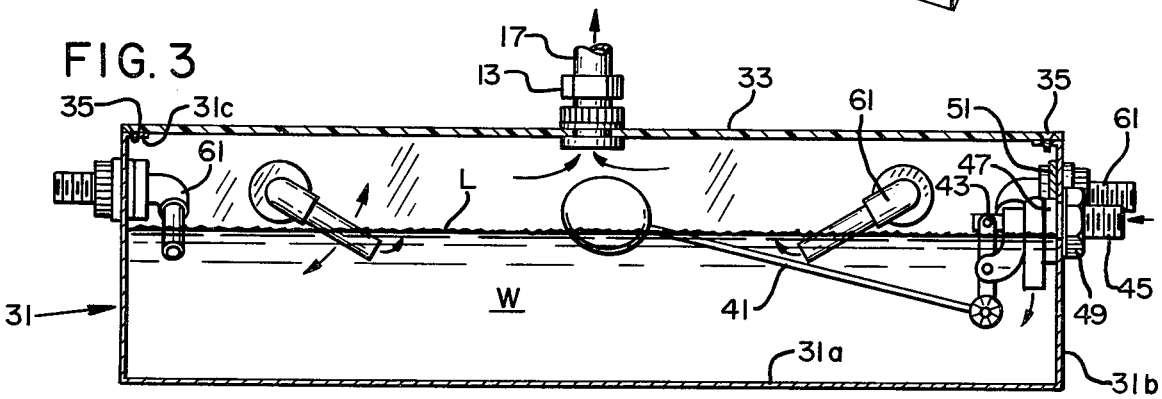
FIG. 4
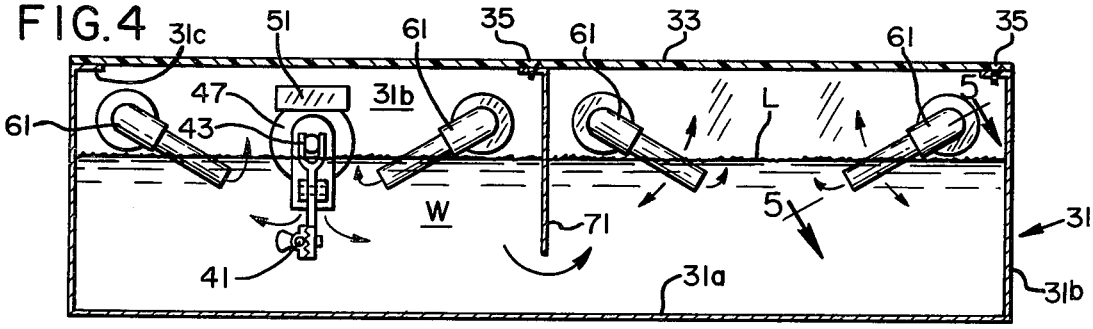
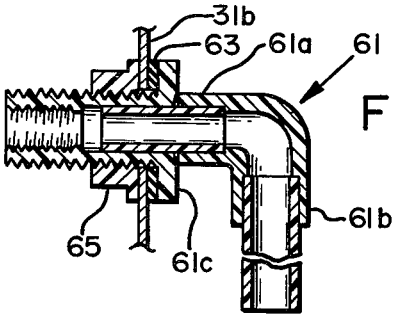
FIG. 5

WATER VAPOR SUPPLY UNIT FOR FOSSIL FUEL BURNER

FIELD OF INVENTION

This invention relates to vapor supply units for fossil fuel burners such as furnaces.

BACKGROUND OF THE INVENTION

The advantages of injecting water vapor into fossil fuel burners is known. A number of devices are now on the market for this purpose, some operating on a suction principle, while others operate on pressure. The present invention relates to the former type, and devices of this type are expensive and cumbersome to maintain and regulate. To my knowledge, prior devices have had an additional handicap if more than one burner is to be serviced. One device per burner is required.

SUMMARY OF THE INVENTION

The present invention overcomes the above disadvantages by providing a relatively inexpensive unit which is easy to maintain and regulate. It has air inlet nozzles so constructed and mounted to permit ready regulation of the amount of vapor produced and has a transparent top to facilitate ready viewing of the nozzles while they are being adjusted. My unit also has a special mount for the water level float control to assure its proper disposition when remounted after being removed.

In addition to the above, my unit can service several burners, and is so constructed as to be able to utilize a common water level control, yet precluding vapor preemption by either burner.

A main object of the present invention is to provide an improved suction type water vapor supply unit and particularly one designed to service several burners or a large single burner that heretofore required more than one water vapor supply unit.

The subject matter which I regard as my invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

FIG. 1 is a diagrammatic view showing an inventive vapor supply unit connected to twin furnaces;

FIG. 2 is a perspective view of the inventive supply unit;

FIG. 3 is a vertical section taken along line 3—3 of FIG. 2;

FIG. 4 is a vertical section taken along line 4—4 of FIG. 2; and FIG. 5 is a sectional view taken along line 5—5 of FIG. 4.

Description of the Preferred Embodiment

FIG. 1 shows a vapor supply unit 11 of the present invention having dual outlets 13 and 15 connected by pipes 17 and 19, respectively, to the burners 21 and 23 of twin furnaces 25 and 27. The burners have blowers that create a subatmospheric pressure which is effective to draw water vapor into the burners and where it is mixed with fuel and injected into the furnaces.

FIG. 2 shows that the vapor supply unit comprises a corrosion resistant tank 31 which is shown as being of rectangular form having a bottom 31*a* and side walls 31*b*. A transparent cover 33 is secured by screws 35 to flanges 31*c* on the walls 31*b*.

The tank contains a body of water W (FIG. 3) maintained at a desired level by a conventional float type level control device 41. The device includes a valve 43 which controls the inflow of water through a pipe 45. The level control device 41 is mounted on the associated wall 31*b* by means of an internal flange 47 (FIG. 4) on the inlet pipe and an external nut 49 on such pipe. The flange is cut away to fit against a fixed stop 51 (FIG. 4) which assures maintaining a proper vertical plane of operation of the float device, however many times it is removed and replaced (such as for maintenance purposes).

Plural air entry nozzles 61 are mounted on the side walls 31*b* of the tank 31. FIG. 5 best shows the details. Each nozzle comprises an angular section of tubing of composite form (preferably of plastic material) having a horizontal leg 61*a* and a second leg 61*b* at right angles to leg 61*a*. Leg 61*a* has an internal flange 61*c* clamping a sealing washer 63 against tank wall 31*b*, the clamping pressure being furnished by a nut 65 threadedly mounted on external threads on leg 61*a*.

The leg 61*b* of each nozzle projects downwardly at a desired angle to a level beneath that of the body of water W. The amount of vapor supplied by the unit can be regulated by loosening the nuts 65 and changing the angular disposition of the legs 61*b*. The deeper the lower ends of the legs 61*b*, the less the amount of air entering the tank and thus the less water vapor that is supplied by the unit.

A separator partition 71 (FIGS. 2 and 4) is provided for the tank to divide it into two compartments, one for the left outlet fitting 13 and the other for the right one, 15. As shown in FIG. 4, the partition extends downwardly below the level L of the water but short of the bottom 31*a* of the tank. This means that while the water level in both compartments can be maintained by the single float device 41 in one compartment, the compartments above the water level are isolated from one another. Thus, even though one furnace burner draws more strongly than the other, it cannot preempt and thus interfere with the vapor drawn in by the other.

While the tank is shown as divided into two compartments, it could be undivided, or divided into more than two to fit the particular installation. Also, while a single vapor outlet is shown for each compartment, an additional outlet could be provided if desired. The angular nozzle 61 could be formed as an integral member clamped in place by its nut.

What is claimed is:

1. A water vapor supply apparatus for a fossil fuel burner, comprising:

an enclosed tank adapted to hold a body of water, first ambient air supply means open to the ambient air externally of the tank above a predetermined water level and communicating with the interior of said tank below said water level, first vapor outlet means on said tank above said level whereby subatmospheric pressure at said vapor outlet means will draw air into said tank through said air supply means and through said water where it will mix therewith and exit through the vapor outlet means as water vapor, second vapor outlet means on said tank spaced from the first, second ambient air supply means on said tank associated with said second vapor outlet means, separator means in said tank located between said first and second outlet means and dividing said tank into two compartments which are isolated from one another above said level so that a higher subatmospheric pressure at one of said outlet means will not affect the quantity of water vapor supplied to the other outlet means, and regulating means in one of said compartments for maintaining the level of the water therein at said predetermined level, said separator means providing for communication between said compartments below said predetermined level so that said regulator means is effective to maintain the same water level in both compartments without adversely affecting the noncommunication between said compartments above said level.

2. A water vapor supply unit as set forth in claim 1, wherein said ambient air supply means can be adjusted to assume different depths in the water in said tank, said tank having a transparent cover to enable the depth of said ambient air supply means to be readily determined exteriorly of said tank.

3. A water vapor supply unit as described in claim 2, wherein there are means for so mounting said regulating means on said tank as to predispose its position in replacing it after its removal.

4. A water vapor supply unit as described in claim 2 wherein said ambient air supply means comprises a nozzle having a pair of angularly related hollow tubular legs, said tank having a side wall, means turnably mounting one of said legs in said side wall, said other leg depending from said one leg to project into a body of water in said tank, means releasably holding said one leg in any of a number of positions of adjustment thereby to regulate the depth of the lower end of said other leg in the body of water whereby to regulate the amount of air that passes through said nozzle.

5. In a water vapor supply unit for a fossil fuel burner, a tank having an upright side wall, plural inlet nozzles for said wall, at least one of said nozzles consisting of a pair of angularly related hollow tubular legs, means turnably mounting one of said legs in said side wall, the free end of said one leg projecting from said side wall and directly communicating with the ambient air, said other leg depending from said one leg to project into a body of water in said tank, the free end of said other leg directly communicating with the water in the tank, holding means releasably holding said one leg in any of a number of positions of adjustment thereby to regulate the depth of the lower end of said other leg in the body of water whereby to regulate the amount of air that passes through said nozzle, closure means for said tank to isolate the interior thereof from the ambient air save for said nozzles, whereby suction applied to said tank will draw ambient air through said nozzles and the body of water and create water vapor and withdraw the same.

6. A water vapor supply unit as described in claim 5, wherein said holding means includes a ring-like nut threaded on said one leg to a position inwardly of the outer end thereof to leave the free end of said one leg open to the atmosphere and to provide a projecting portion functioning as a handle by which adjustment of the position of said one nozzle may be effected from a location outwardly of the side wall of said tank, the friction created by said nut, when tightened, being sufficient to hold said one nozzle in any position of adjustment.

7. A unit as recited in claim 5, wherein there are suction means connected to said tank.

8. A unit as recited in claim 5 wherein there are regulating means for regulating the level of the water in the tank.

9. A unit as recited in claim 8 in which there are suction means connected to said tank.

10. A unit as recited in claim 9 in which said holding means includes a ring-like nut threaded on said one leg to a position inwardly of the outer end thereof to leave the free end of said one leg open to the atmosphere and to provide a projecting portion functioning as a handle by which adjustment of the position of said one nozzle may be effected from a location outwardly of the side wall of said tank, the friction created by said nut, when tightened, being sufficient to hold said one nozzle in any position of adjustment.

* * * * *